US008125348B2

(12) United States Patent
Cemper

(10) Patent No.: US 8,125,348 B2
(45) **Date of Patent: *Feb. 28, 2012**

(54) AUTOMOBILE BEACON, SYSTEM AND ASSOCIATED METHOD

(75) Inventor: Kirk E. Cemper, Richardson, TX (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 589 days.

This patent is subject to a terminal disclaimer.

(21) Appl. No.: 11/771,684

(22) Filed: Jun. 29, 2007

(65) Prior Publication Data

US 2009/0002197 A1 Jan. 1, 2009

(51) Int. Cl.
*G08G 1/00* (2006.01)

(52) U.S. Cl. ..... 340/901; 340/902; 340/904

(58) Field of Classification Search ..... 340/901, 340/902, 903, 904, 988, 425.5, 435, 436, 340/500, 539.1, 539.11; 455/99; 342/42
See application file for complete search history.

(56) References Cited

U.S. PATENT DOCUMENTS 3,840,868 A * 10/1974 Campman ..... 340/555
4,582,280 A * 4/1986 Nichols et al. ..... 246/182 R
5,619,181 A * 4/1997 Murray ..... 340/407.1
5,752,163 A * 5/1998 Robinson ..... 340/7.21
5,889,475 A * 3/1999 Klosinski et al. ..... 340/902
6,472,978 B1 * 10/2002 Takagi et al. ..... 340/435
6,731,202 B1 * 5/2004 Klaus ..... 340/425.5
6,861,959 B1 * 3/2005 Torres Sabate et al. ..... 340/944
7,327,282 B2 * 2/2008 Crocker et al. ..... 340/936
2004/0217869 A1 * 11/2004 Bouchard et al. ..... 340/573.4
2005/0073438 A1 * 4/2005 Rodgers et al. ..... 340/944
2008/0061978 A1 * 3/2008 Huang ..... 340/572.1

FOREIGN PATENT DOCUMENTS

JP 2002074593 A * 3/2002

* cited by examiner

*Primary Examiner* — George Bugg
*Assistant Examiner* — Kerri McNally

(57) ABSTRACT

Devices, systems, and methods are provided for alerting a pedestrian, such as a visually impaired pedestrian, of a vehicle in the vicinity. In general, signals are transmitted from a vehicle to a device carried by a pedestrian, such as a mobile terminal. In response, the pedestrian's device may generate an alarm, such as a vibration or an audible alarm, informing the pedestrian that a vehicle is nearby. In some cases, the pedestrian's device may transmit activation signals to the vehicle after receiving the signals from the vehicle. The activation signals may cause speakers on the vehicle to emit an audible alarm, alerting the pedestrian of the presence of the vehicle.

17 Claims, 5 Drawing Sheets

AUTOMOBILE BEACON, SYSTEM AND ASSOCIATED METHOD

BACKGROUND

People who are blind or visually impaired often rely on their other senses to help compensate for their lack of sight. A visually impaired person may, for example, rely on the sound of his shoes striking the floor to identify rooms, doorways, and objects in the vicinity. Similarly, a visually impaired pedestrian may use the sound and frequency of engine noise to determine the location, speed, and direction of motor vehicles when walking near roadways.

With interest in environmentally-friendly sources of energy and the desire to reduce dependence on foreign oil on the rise, the number of battery electric vehicles (BEVs) and hybrid-electric vehicles (HEVs) on the road is increasing. Because BEVs and HEVs are powered, at least part of the time, by an electric motor rather than a combustion engine, such vehicles do not produce as much noise as conventional, gas-powered vehicles. These quiet vehicles may be more difficult for a visually impaired person to detect and navigate around as compared to conventional vehicles and, as a result, may present a greater risk of harm to the visually impaired. To avoid such dangers posed by quiet-running vehicles, some visually impaired individuals may need help from other people or may have to avoid certain activities all together. As a result, some visually impaired individuals may lose some of their independence, which may detract from their quality of life.

Thus, there is a need for a system that provides a pedestrian with a warning when a vehicle is near without causing prolonged periods of noise that would disrupt other people in the area.

BRIEF DESCRIPTION OF THE SEVERAL VIEWS OF THE DRAWING(S)

DETAILED DESCRIPTION

Exemplary embodiments now will be described hereinafter with reference to the accompanying drawings, in which exemplary embodiments and examples are shown. Like numbers refer to like elements throughout.

Devices, systems, and methods for alerting a pedestrian of a vehicle in the vicinity are provided in accordance with various exemplary embodiments. In general, devices, systems and methods are described for transmitting signals from a vehicle to a device carried by a pedestrian. In response, the pedestrian's device may generate an alarm, such as a vibration or an audible alarm, informing the pedestrian that a vehicle is nearby. In some cases, the pedestrian's device may transmit activation signals to the vehicle after receiving the signals from the vehicle. The activation signals may cause speakers on the vehicle to emit an audible alarm, alerting the pedestrian of the presence of the vehicle.

Figure 1:
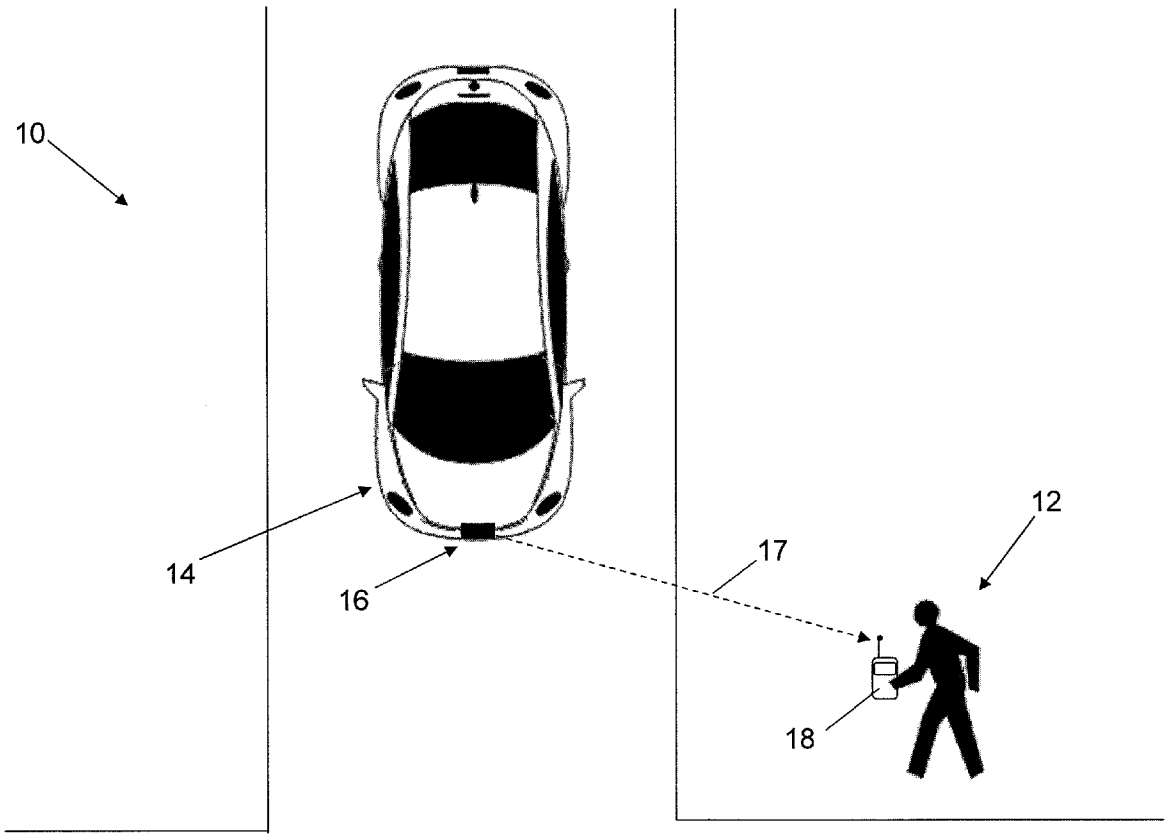
FIG. 1 is a schematic representation of a system for alerting a pedestrian according to one embodiment.

FIG. 1 illustrates a system 10 for alerting a pedestrian 12 of a nearby vehicle 14. The system 10 includes a vehicle device 16 carried by the vehicle 14 and a user device 18 carried by the pedestrian 12. The vehicle device 16 is configured to send signals 17 to the user device 18 indicating a presence of the vehicle 14, and the user device 18 is configured to receive the signals 17 from the vehicle device 16. Typically, the transmission and reception of the signals is performed wirelessly. In response to receiving the signals 17 from the vehicle device 16, the user device 18 is configured to alert the pedestrian 12 regarding the presence of the vehicle 14 in proximity to the pedestrian 12.

Figure 2:
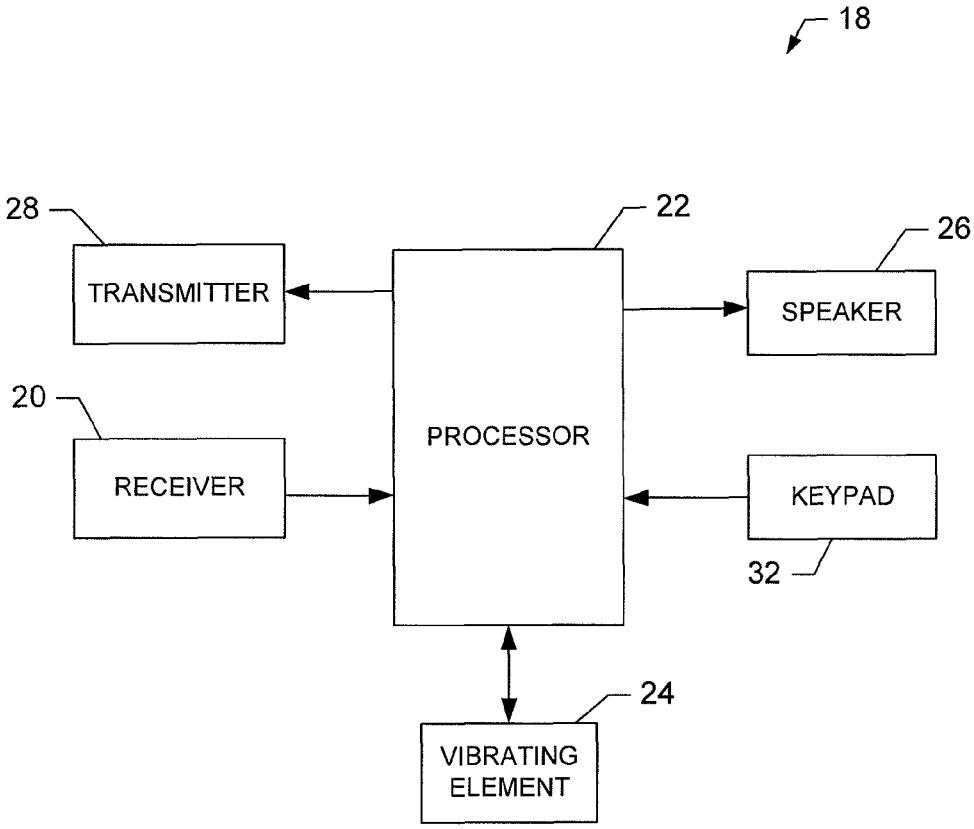
FIG. 2 is a schematic block diagram of a user device according to one embodiment.

Referring to FIG. 2, the user device 18 may include a receiver 20 and a processor 22 in communication with the receiver 20. The receiver 20 may be configured to receive the signals from the vehicle device 16, and, in response, the processor 22 may be configured to provide an alert to the pedestrian regarding the presence of the vehicle 14 in the vicinity of the pedestrian 12. The user device 18 may be configured (i.e., sized and shaped) in various ways. For example, the user device 18 may be configured to fit on a key chain or in the pocket of an individual. The user device 18 may also be configured to clip onto an individual's belt loop, pocket, or other article of clothing, or may be designed to be worn as an accessory, such as a belt or purse. In some embodiments, the user device 18 may include a mobile terminal, such as a mobile phone (as shown in the figures), portable digital assistant (PDA), pager, or other type of voice or text communications system. For example, dedicated circuitry may be integrated with a mobile terminal to provide the functions of the user device 18 simultaneously with the functions of the mobile terminal.

The user device 18 may include a vibrating element 24 in communication with the processor 22. For example, the vibrating element 24 may be a vibrating battery pack or any other component capable of providing mechanical vibration as a detectable output. The processor 22 may be configured to cause the vibrating element 24 to vibrate in response to receiving signals 17 from the vehicle device 16. In this way, the pedestrian 12 may be able to sense the presence of a vehicle nearby by feeling the mechanical vibration produced by the vibrating element 24. Characteristics of the vibrations may vary to convey additional information about the vehicle 14 to the pedestrian 12. For example, the intensity (i.e., strength) of the vibrations may be greater when the vehicle 14 is closer to the pedestrian 12 and may be lesser when the vehicle 14 is farther away. In this way, vibrations that are increasing in intensity may indicate an approaching vehicle 14, whereas vibrations that are decreasing in intensity may indicate a vehicle 14 that is moving away from the pedestrian 12.

Furthermore, the user device 18 may include a speaker 26 in communication with the processor 22. If the user device 18 includes or is otherwise part of a mobile terminal, for example, the speaker 26 may be the speaker of the mobile terminal. In any case, the processor 22 may be configured to cause the speaker 26 to issue an audible alarm in response to receiving the signals 17 from the vehicle 14. The speaker 26 may be configured to issue various types of alarms. For example, the alarm issued by the speaker 26 may be a continuous tone having a constant pitch, or the alarm may vary in one or more respects to convey additional information about the vehicle 14 whose presence was detected.

The alarm issued by the speaker 26, for example, may consist of a series of tones that are separated, one from the next, by a pause according to the strength of the signal 17 received. A weaker signal 17, such as a signal 17 transmitted by a vehicle 14 that is farther away and/or traveling at a slower velocity, may result in a series of tones that issue at 3-second intervals. A relatively stronger signal 17, such as a signal 17 transmitted by a vehicle 14 that is closer to the pedestrian 12 and/or traveling at a higher velocity, may result in tones that issue every second. In this way, the tones may sound closer together to the pedestrian as the vehicle 14 approaches, making a continuous or almost continuous sound when the vehicle 14 is closest to the pedestrian 12 (e.g., when the vehicle 14 is passing next to the pedestrian 12). Thus, the pedestrian 12 may be able to gauge how much time he has until the vehicle passes. Similarly, the alarm issued by the speaker 26 may vary in pitch, going from a lower pitch to a higher pitch as the vehicle gets closer to the pedestrian, likewise providing the pedestrian with additional information regarding the speed, distance, and/or direction of travel of the vehicle. It is important to note, however, that the frequency of the tones sounded by the alarm may be independent of the frequency of the signals 17 received from the vehicle device 16. Thus, although the alarm issued by the speaker 26 may be a series of tones sounded at equal intervals in some situation, the signals 17 may not necessarily be transmitted by the vehicle device 16 at constant intervals, as will be described below.

Figure 3:
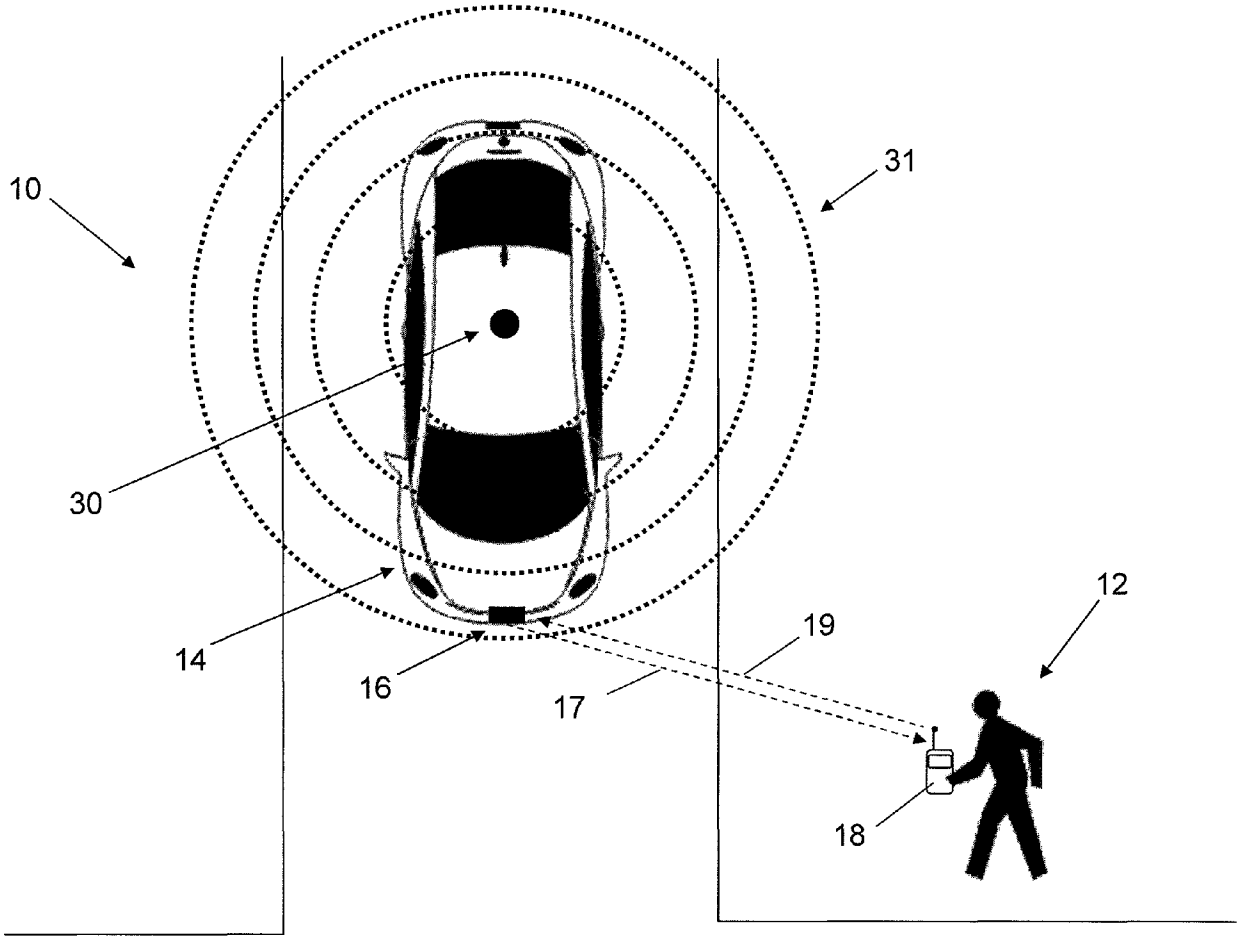
FIG. 3 is a schematic representation of a system for alerting a pedestrian according to another embodiment.

Referring to FIGS. 2 and 3, in some embodiments instead of the user device 18 issuing the alarm (for example, generating vibrations or producing a series of tones), the user device 18 may send signals back to the vehicle device 16 to cause the vehicle device 16 to issue the alarm. In this regard, the user device 18 may include a transmitter 28 in communication with the processor 22. The processor 22 may be configured to instruct the transmitter 28 to transmit activation signals 19 to the vehicle device 16 in response to receiving the signals 17 indicating the presence of the vehicle 14. The activation signals 19 may cause the vehicle device 16 to issue an audible alarm 31, for example through one or more speakers 30 that may be mounted on the vehicle 14, as described below. The audible alarm 31 may, for example, announce the presence of the vehicle (e.g., by repeating the phrase "vehicle approaching" or "caution") or may consist of a constant or variable tone, as described above in conjunction with the speaker 26 of the user device 18. The pedestrian 12 may be able to judge the direction that the vehicle is traveling (e.g., towards the pedestrian or away from the pedestrian) according to the frequency of the alarm (i.e., the Doppler effect) and may also be able to determine the relative distance of the vehicle 14 based on the volume of the alarm.

In addition, the presence of the pedestrian in possession of the user device 18 may be conveyed to the driver of the vehicle 14 through the activation signals 19. Examples of devices, systems, and methods for conveying this information to the driver are described in U.S. patent application Ser. No. 11/771,718 entitled "Driver Notification System, Device, and Associated Method", filed concurrently, which is incorporated herein in its entirety by reference.

The user device 18 may also include other components to facilitate the use and configuration of the user device 18 by the pedestrian 12. For example, as shown in FIG. 2, the user device 18 may include a keypad 32 or any other user input device that can allow the user device 18 to receive data from the user (i.e., the pedestrian 12). In this way, the pedestrian 12 may be able to select the type of output produced by the user device 18 upon receiving signals 17 from the vehicle device 16 (such as vibration versus audible) as well as adjust other options (such as the strength of the activation signals 19, the tone used for the audible alarm, etc.). In some embodiments, the user device 18 may be configured to distinguish between approaching vehicles and vehicles that are moving away from the pedestrian 12. For example, the user device 18 may consider the amplitude of the signals 17 to determine that signals 17 that are increasing in strength are approaching the user device 18 and signals 17 that are decreasing in strength are moving away. In this regard, the user device 18 may be configured to provide alerts to the pedestrian 12 only for those vehicles that are approaching, rather than for those that are approaching and for those that are moving away.

Figure 4:
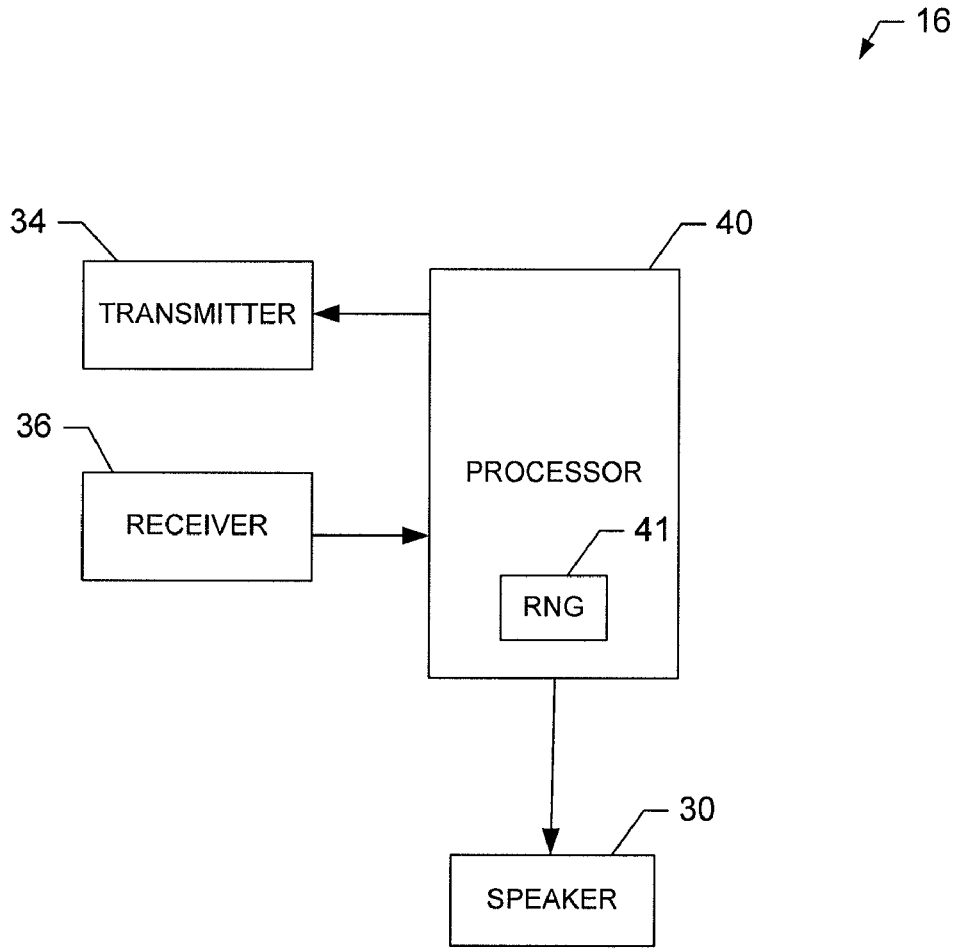
FIG. 4 is a schematic block diagram of a vehicle device according to one embodiment.

Referring now to FIG. 4, the vehicle device 16 that is configured to send the signals 17 to the user device 18 may include a transmitter 34 and a processor 40 in communication with the transmitter 34. In some embodiments, the vehicle device 16 may also include a receiver 36 and one or more speakers 30 in communication with the processor 40. The receiver 36 may be configured to receive activation signals 19 (see FIG. 3) from the user device 18, as previously described, and the speaker or speakers 30 may be configured to issue an audible alarm 31 as instructed by the processor 40 when the activation signals 19 are received from the user device 18 by the receiver 36.

The vehicle device 16 may be mounted on the outside of the vehicle 14, such as at the front of the vehicle (e.g., on the hood as shown in the figures) or on the roof of the vehicle, or the vehicle device 16 may be located inside the vehicle, similar to a stereo or navigation system installation. In embodiments including one or more speakers 30, the speaker(s) 30 may be co-located with the transmitter 34, receiver 36, and processor 40, for example at the front exterior of the vehicle 14, or the speaker(s) 30 may be located at a separate location. For example, as shown in FIG. 3, the speaker(s) 30 may be mounted on the roof of the vehicle, physically separate from the remainder of the vehicle device 16, whereas the vehicle device 16 (i.e., the transmitter 34, receiver 36, and processor 40) may be located at the front of the vehicle 14. Regardless of whether the speaker(s) 30 are physically integrated with the rest of the vehicle device 16, circuitry may connect the transmitter 34, receiver 36, and speaker(s) 30 with the processor 40 such that the vehicle device 16 may transmit signals 17 to the user device 18 and respond to any activation signals 19 which may be sent by the user device 18.

Referring to FIGS. 1 and 3, the signals 17 transmitted by the transmitter 34 may be a radio frequency (RF) signal transmitted on a controlled frequency that all equipped vehicles share. For example, a frequency or range of frequencies may be set aside by the Federal Communications Commission (FCC) for use only by vehicles 14 carrying vehicle devices 16 such that the reserved frequencies would be unavailable to the public without appropriate licensing. Vehicle manufacturers could then be issued a general license that acts as an umbrella for all vehicles 14 manufactured with vehicle devices 16.

Furthermore, the transmitter 34 may be configured to transmit the signals 17 in random bursts. For example, the time between bursts may be governed by a random number generator (RNG) 41 in the processor 40, as shown in FIG. 4. Thus, although two vehicles may both be transmitting 100 bursts per second, for example, the intervals between bursts (i.e., how the 100 bursts are distributed through that one second of time) may be governed by the RNG 41, and the distribution of the 100 bursts may be different as between the two vehicles. In this way, creation of a complex Fresnel field as a result of multiple vehicles transmitting signals 17 according to a constant function (e.g., a constant sine wave) may be avoided, and the risk of signals 17 transmitted by one vehicle canceling out signals 17 transmitted by another vehicle may be reduced. Although when a number of vehicles 14 are present it may still be statistically possible for random bursts from two vehicle devices 16 to cancel each other out, the duration of the cancellation would be relatively insignificant (on the order of 1/100 of a second, using the example above) and would have no practical effect on the functioning of the user device 18. Furthermore, the user device 18 may still receive signals 17 from the other vehicles 14 transmitting the signals 17. Thus, even though the pedestrian may not necessarily be able to determine how many vehicles 14 are in the vicinity, the pedestrian may still be alerted that at least one vehicle 14 is in the vicinity.

Figure 5:
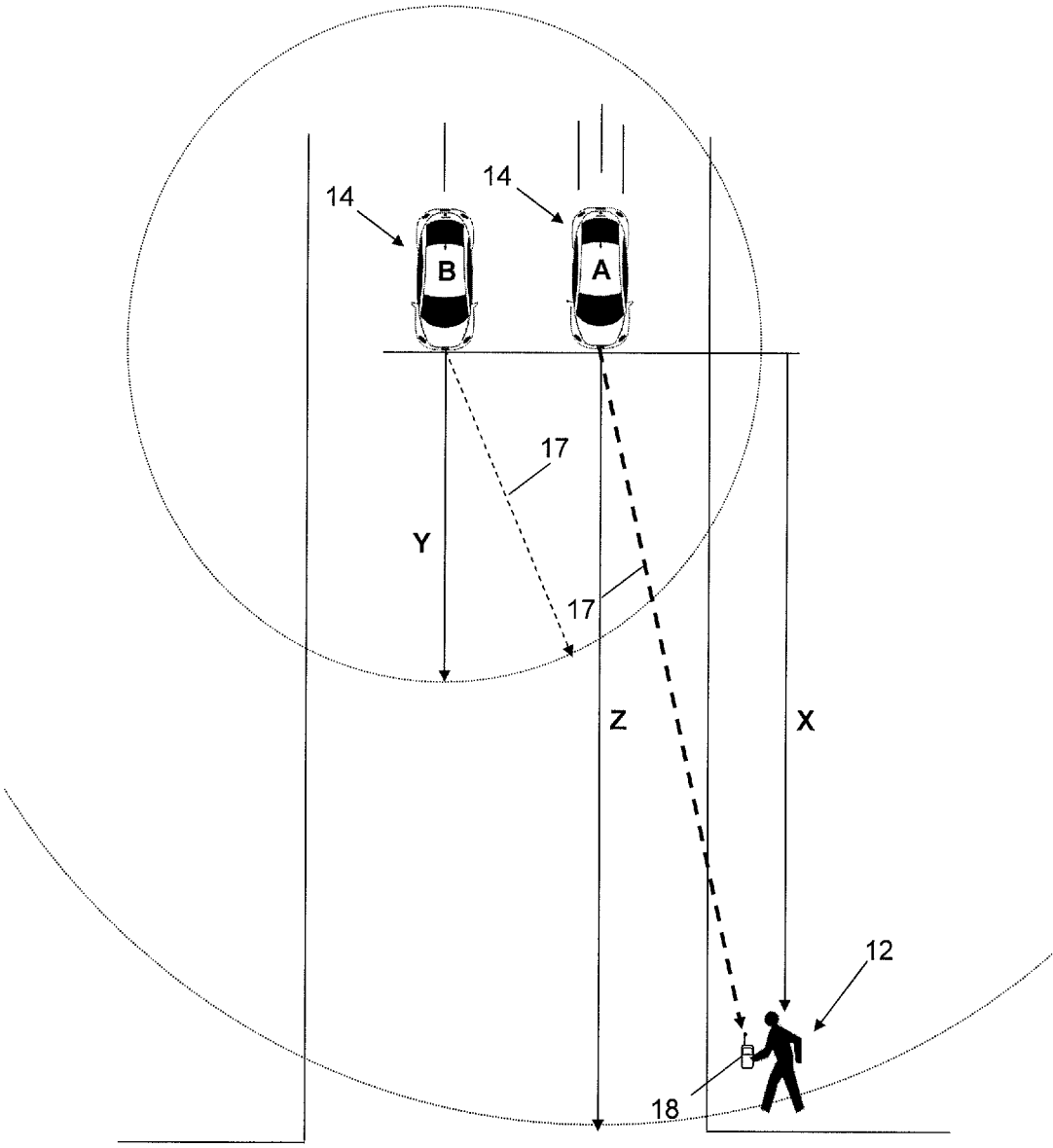
FIG. 5 is a schematic illustration of the variation in signal strength as a function of the velocity of the vehicle according to another embodiment.

As previously mentioned, the transmitter 34 may also be configured to transmit the signals 17 with a signal strength that is associated with the speed of the vehicle 14. For example, instead of transmitting the signals 17 at a constant amplitude (i.e., a constant strength), the transmitter 34 may transmit the signals 17 at an amplitude that is a function of the velocity of the vehicle 14. For instance, FIG. 5 shows two vehicles A, B approaching a pedestrian 12 carrying a user device 18. Vehicles A and B are at the same distance X away from the pedestrian 12. However, vehicle A is traveling three times as fast as vehicle B (as represented by three velocity lines coming off the rear of vehicle A as compared to the one line off B). The function typically implemented by the processor 40 that provides appropriate commands to the transmitter 34 governing the amplitude of the signals 17 may dictate that the higher velocity vehicle A may transmit the signals 17 at a greater amplitude (higher strength) than the lower velocity vehicle B, as indicated by the darker dashed line representing the signals 17. The signals 17 from vehicle A may thus be attenuated (i.e., become too weak to be detected) at a distance Z, whereas the signals 17 from vehicle B may be attenuated at a shorter distance Y. In this way, the signals 17 from vehicle A may reach the pedestrian 12 even though the lower signal strength of vehicle B do not. Thus, a pedestrian 12 standing at a distance X from both vehicles A and B may receive only the set of signals 17 that would cause the pedestrian 12 to react—in this case the signals 17 from vehicle A.

As previously mentioned, in some embodiments (as shown in FIGS. 3 and 4) in which the vehicle device 16 includes a receiver 36 and one or more speakers 38, the vehicle device 16 may be configured to receive activation signals 19 from the user device 18. The activation signals 19 received by the vehicle device 16 may be an RF signal, as described above in conjunction with the signals 17 transmitted by the vehicle device 16. The activation signals 19 may be transmitted by the user device 18 using a different frequency than the frequency used by the vehicle device 16 to transmit the signals 17 so that a particular vehicle device 16 may distinguish the activation signals 19 from other signals 17 that may be transmitted by other vehicles 14 with vehicle devices 16. Alternatively, the activation signals 19 may be modulated or may otherwise include information characterizing those signals as activation signals 19. For example, the activation signals 19 may include a header indicating that the signals are being transmitted by a particular user device 18. In this way, the same frequency may be used by the user device 18 to transmit the activation signals 19 as is used by the vehicle device 16 to transmit the signals 17.

Referring again to FIG. 3, in some embodiments including a receiver 36 and one or more speakers 30 of the vehicle device 16, the processor 40 may be configured to instruct the speaker(s) 30 to issue an audible alarm 31 as long as the receiver 36 continues to receive the activation signals 19 and for a predetermined amount of time after the receiver 36 ceases to receive the activation signals 19. For example, there may be a two-second delay between the time the receiver 36 stops receiving activation signals 19 from the user device 18 and the time the processor 40 stops instructing the speaker(s) 30 to issue the audible alarm. In this way, even if transmission of the activation signals 19 by the user device 18 is interrupted for some reason, for example if the activation signals 19 are blocked by a building, a wall, or some other structure or if other signals in the area momentarily cancel out the activation signals 19, the pedestrian 12 may continue to perceive the audible alarm despite the transient obstruction of the activation signals 19. Otherwise, without such a delay, the pedestrian 12 may get the false impression that the vehicle 14 is no longer approaching (e.g., the vehicle 14 has turned and is no longer heading toward the pedestrian 12). However, if the vehicle 14 has indeed turned or is otherwise no longer in the vicinity of the pedestrian 12, the speaker(s) 30 may stop issuing the audible alarm following the predetermined time delay (e.g., 2 seconds), thereby conveying to the pedestrian 12 that there is no longer a vehicle 14 in the area.

In the preceding specification, various embodiments of the claimed invention have been described. It will, however, be evident that various modifications and changes may be made thereunto without departing from the broader spirit and scope of the invention as set forth in the claims that follow. The specification and drawings are accordingly to be regarded in an illustrative rather than restrictive sense.

That which is claimed:

1. A system comprising:

a first device carried by a vehicle and configured to send signals indicating a presence of the vehicle, further configured to alter an amplitude of the signals to provide an indication of a speed of the vehicle;

a second device carried by a pedestrian and configured to receive the signals from the first device; and at least one speaker carried by the vehicle in communication with the first device, wherein the second device is configured to transmit activation signals to the first device in response to receiving the signals from the first device, and wherein the first device is configured to instruct the at least one speaker to issue an audible alarm in response to receiving the activation signals from the second device;

wherein the second device is configured to alert the pedestrian regarding the presence of the vehicle in proximity to the pedestrian in response to receiving the signals from the first device, the second device being further configured to allow the pedestrian to select a type of alert received, and wherein the second device is further configured to sound a tone more frequently as the vehicle gets closer to the second device.

2. The system of claim 1, wherein the first device is configured to send the signals in random bursts.

3. The system of claim 1, wherein the first device is configured to send the signals with a signal strength that is associated with the speed of the vehicle.

4. The system of claim 1, wherein the second device is configured to vibrate in response to receiving the signals from the first device.

5. The system of claim 1, wherein the second device comprises a mobile terminal.

6. A device comprising:

a receiver configured to receive signals from a vehicle indicating a presence of the vehicle;

a processor in communication with the receiver configured to provide an alert to a user regarding the presence of the vehicle in proximity to the user in response to receiving the signals, wherein an amplitude of the signals is altered to provide an indication of a speed of the vehicle; and a transmitter in communication with the processor, wherein the processor is configured to instruct the transmitter to transmit activation signals to the vehicle in response to receiving the signals indicating the presence of the vehicle such that the activation signals cause the vehicle to issue an audible alarm;

wherein the receiver is configured to allow the user to select a type of alert received, and wherein the receiver is further configured to sound a tone more frequently as the vehicle gets closer to the receiver.

7. The device of claim 6 further comprising a vibrating element in communication with the processor, wherein the processor is configured to cause the vibrating element to vibrate in response to receiving the signals from the vehicle.

8. The device of claim 6 further comprising a speaker in communication with the processor, wherein the processor is configured to cause the speaker to issue an audible alarm in response to receiving the signals from the vehicle.

9. The device of claim 6, wherein the device comprises a mobile terminal.

10. A device comprising:

a transmitter configured to transmit signals indicating a presence of a vehicle to a user device in proximity to the vehicle, the transmitter configured to transmit signals with an interval between signals governed at least in part by a random number generator, wherein an amplitude of the signals is altered to provide an indication of a speed of the vehicle;

a receiver configured to receive activation signals from the user device;

at least one speaker configured to issue an audible alarm; and a processor in communication with the transmitter, the receiver, and the at least one speaker;

wherein the signals transmitted by the transmitter cause the user device to transmit the activation signals, and wherein the processor is configured to instruct the at least one speaker to issue the audible alarm as long as the receiver continues to receive the activation signals and for a predetermined amount of time after the receiver ceases to receive the activation signals.

11. The device of claim 10, wherein the transmitter is configured to transmit the signals in random bursts.

12. The device of claim 10, wherein the transmitter is configured to transmit the signals with a signal strength that is associated with the speed of the vehicle.

13. A method comprising:

receiving an input from a user indicating a desired type of alert;

receiving, using an electronic receiver, signals at a location of a user indicating a presence of a vehicle, wherein signals have an amplitude providing an indication of a speed of the vehicle;

alerting the user regarding the presence of the vehicle in proximity to the user in response to receiving the signals, wherein the user is alerted with the desired type of alert, wherein the alert comprises a tone sounded more frequently as the vehicle gets closer to the electronic receiver; and ceasing to alert the user after a predetermined amount of time following cessation of the signals.

14. The method of claim 13, wherein receiving the signals comprises receiving the signals from a plurality of vehicles.

15. The method of claim 13, wherein alerting the user comprises producing vibrations at the location of the user.

16. The method of claim 13, wherein alerting the user comprises transmitting activation signals to the vehicle to cause the vehicle to issue an audible alarm.

17. The method of claim 13 further comprising adjusting a strength of the activation signals based on a user input.

* * * * *